United States Patent [19]

Kim

[11] Patent Number: 4,615,635

[45] Date of Patent: Oct. 7, 1986

[54] TOOTHBRUSH WITH FLOW CONTROL VALVE

[76] Inventor: Kun H. Kim, 69 Woodside Dr., Washington, Pa. 15301

[21] Appl. No.: 742,952

[22] Filed: Jun. 10, 1985

[51] Int. Cl.[4] ..... A46B 11/00

[52] U.S. Cl. ..... 401/270; 401/134; 401/190; 401/269; 401/286

[58] Field of Search ..... 401/287, 286, 270, 278, 401/184, 186, 175, 134, 290, 269

[56] References Cited

U.S. PATENT DOCUMENTS

| | | | |
|---|---|---|---|
| 818,000 | 4/1906 | Stevenson . | |
| 1,329,944 | 2/1920 | Williams | 401/270 X |
| 1,518,341 | 12/1924 | Mendoza . | |
| 1,701,030 | 2/1929 | Collins | 401/278 |
| 1,712,141 | 5/1929 | Folk | 401/134 |
| 1,768,301 | 6/1930 | Weber . | |
| 1,835,069 | 12/1931 | Lougren | 401/134 |
| 2,259,928 | 10/1941 | Eaton | 15/136 |
| 2,536,968 | 1/1951 | Tirocchi et al. | 15/135 |
| 2,743,042 | 4/1956 | Burgin | 222/191 |
| 2,820,979 | 1/1958 | Herter | 15/135 |
| 3,187,365 | 6/1965 | Paul | 401/184 |
| 3,227,165 | 1/1966 | Costanza | 132/84 |
| 3,712,747 | 1/1973 | Drohomirecky | 401/155 |
| 4,124,316 | 11/1978 | O'Rourke | 401/184 |
| 4,135,831 | 1/1979 | Reitknecht | 401/175 |
| 4,221,492 | 9/1980 | Boscardin et al. | 401/184 |

FOREIGN PATENT DOCUMENTS

| | | | |
|---|---|---|---|
| 1178036 | 9/1964 | Fed. Rep. of Germany . | |
| 456621 | 9/1913 | France . | |
| 2452265 | 10/1980 | France | 401/286 |
| 2070922 | 9/1981 | United Kingdom | 401/287 |

*Primary Examiner*—Steven A. Bratlie

*Attorney, Agent, or Firm*—Webb, Burden, Robinson & Webb

[57] ABSTRACT

A toothbrush includes an elongated shank suitable for mounting onto a toothpaste container at a first end thereof and having a brush head at a second end. A plurality of bristles are carried by the brush head and extend outwardly from an upper surface thereof. A longitudinal passageway extends from the first end of the shank, through the shank, and exits in an opening within the bristles of the brush head. A slide mechanism is mounted in an elongated channel in the upper surface of the shank and is in slidable engagement therewith. The slide extends along the shank and into the brush head and has a first end disposed within the bristles which is formed in a plug complementary with the opening. The slide can be moved from a first position in which the plug completely covers the opening to a second position in which the opening is uncovered.

16 Claims, 15 Drawing Figures

TOOTHBRUSH WITH FLOW CONTROL VALVE

BACKGROUND OF THE INVENTION

1. Field of the Invention

My invention relates to a toothbrush and, more particularly, to a toothbrush which dispenses toothpaste directly onto the bristles from an attached toothpaste container.

2. Description of the Prior Art

The use of toothbrushes of the general type which dispense toothpaste from an attached container, through the toothbrush, and then directly onto the bristles is well known in the art. Examples of such prior art toothbrushes are shown in U.S. Pat. Nos. 818,000; 1,518,341; 1,768,301; 2,259,928; 2,536,968; 2,743,042; 2,820,979; 3,227,165; 3,712,747; 4,124,316; and 4,221,492; German Auslegeschrift No. 1178036; and French Pat. No. 456621. Most of these arrangements are very complicated and require that a specific handle be built into the toothbrush to accommodate a tube of toothpaste. Some have special toothpaste containers that are used in connection therewith. Perhaps the most serious problem with many of the prior art devices is that the opening which dispenses the toothpaste into the bristles of the brush remains open and, thus, the toothpaste remaining within the device can easily become contaminated or will become solidified due to exposure to the air.

However, it is known in the prior art that the opening of an internal passageway in the vicinity of the bristles can be closed off. See, for example, the arrangements shown in U.S. Pat. Nos. 818,000; 1,518,341; 4,124,316; and 4,221,492. The arrangements shown in U.S. Pat. Nos. 4,124,316 and 4,221,492 are totally unsatisfactory due to the complexity of the closure device and the fact that the closure device is completely built within the toothbrush. Such a device can easily become clogged due to the nature of the toothpaste and it is rather difficult to clean such a device. The pin arrangement shown in U.S. Pat. No. 818,000 for closing off the opening into the bristles is rather inconvenient to use. The slide closure arrangement shown in U.S. Pat. No. 1,518,341 cannot be operated with one hand, is rather complicated to build, and is not as easy to clean or to manufacture as is desirable.

Accordingly, it is an object of the present invention to provide a toothbrush which can be mounted onto a toothpaste container and dispense the toothpaste directly onto the bristles of the toothbrush.

It is a further object of the present invention to provide such a toothbrush in which the opening into the bristle area is positively and securely closed off when not in use so that the toothpaste does not become contaminated or exposed to the air.

It is a further object of the present invention to provide such a toothbrush which is easy and inexpensive to manufacture, easy to use, and which has a minimum number of moving parts.

SUMMARY OF THE INVENTION

Accordingly, I have invented a toothbrush which is adapted to be mounted onto a toothpaste container which includes an elongated shank having a means for mounting a toothpaste container to a first end thereof and having a brush head at a second end, with a plurality of bristles carried by the brush head and extending outwardly from an upper surface thereof. The toothbrush also includes a longitudinal passageway extending from the first end of the shank, through the shank and exiting in an opening within the bristles in the brush head. A slide mechanism is provided at an upper surface of the shank which extends along the shank and into the brush head and has means mounting the slide mechanism to the shaft for slidable movement therewith. The slide mechanism had a first end disposed within the bristles and formed in a plug complementary with the opening. The slide mechanism is movable from a first position in which the plug completely covers the opening to a second position in which the opening is uncovered.

Preferably, the means mounting the slide mechanism is an elongated channel in the upper surface of the shank, and the slide mechanism is in slidable engagement with the channel. The channel may include a pair of opposed and spaced sidewalls which angle downwardly away from each other. In an alternate embodiment, the channel includes a pair of opposed and spaced sidewalls having an arcuate configuration. In a third embodiment, the channel includes a pair of opposed and spaced sidewalls, with each of the sidewalls having at least one elongated notch therein and the slide mechanism has an elongated rib complementary with and engaging each notch in the sidewalls.

In a preferred embodiment, the toothbrush includes a raised portion in the upper surface of the brush head, and the elongated passageway extends through the raised portion and exits in the opening in the top of the raised portion. It is preferred that the raised portion have an arcuate outer surface and that the plug have an arcuate outer surface which is complementary with the raised portion. In this manner, an unbroken arcuate surface is formed when the slide mechanism is moved to the first position with the plug covering the opening. The surface area defined by the raised portion is about one-third the area of the upper surface of the brush head and the height of the raised portion is about one-half the height of the bristles.

The first end of the slide mechanism may include a plurality of bristles thereon and the second end of the slide mechanism may include a thumb bead for easy movement of the slide. The means for mounting a toothbrush container to the toothbrush is preferably an internally threaded socket in the first end of the toothbrush, and the socket is in fluid communication with the longitudinal passageway. In order that the toothbrush may be mounted onto an aerosol-type of toothpaste container, it is desirable to provide the internally threaded socket with a means for rupturing the top of an aerosol toothpaste container, such as a hook-shaped member or a plurality of spaced blades mounted therein.

In order to provide the above described toothbrush in an arrangement capable of being carried in one's pocket, it is convenient to provide the toothbrush with a tubular cover which fits over the brush head and shank and which removably engages the first end of the shank. The toothbrush may also include a tubular base which fits over a toothpaste container mounted to the shank and which is removably engaged with the first end of the shank. The tubular base has at least an upper portion along its length which is formed of a flexible material in order that the container disposed therein can be squeezed to dispense the toothpaste without removing the tubular base.

DESCRIPTION OF THE PREFERRED EMBODIMENTS

Figures 1, 2:
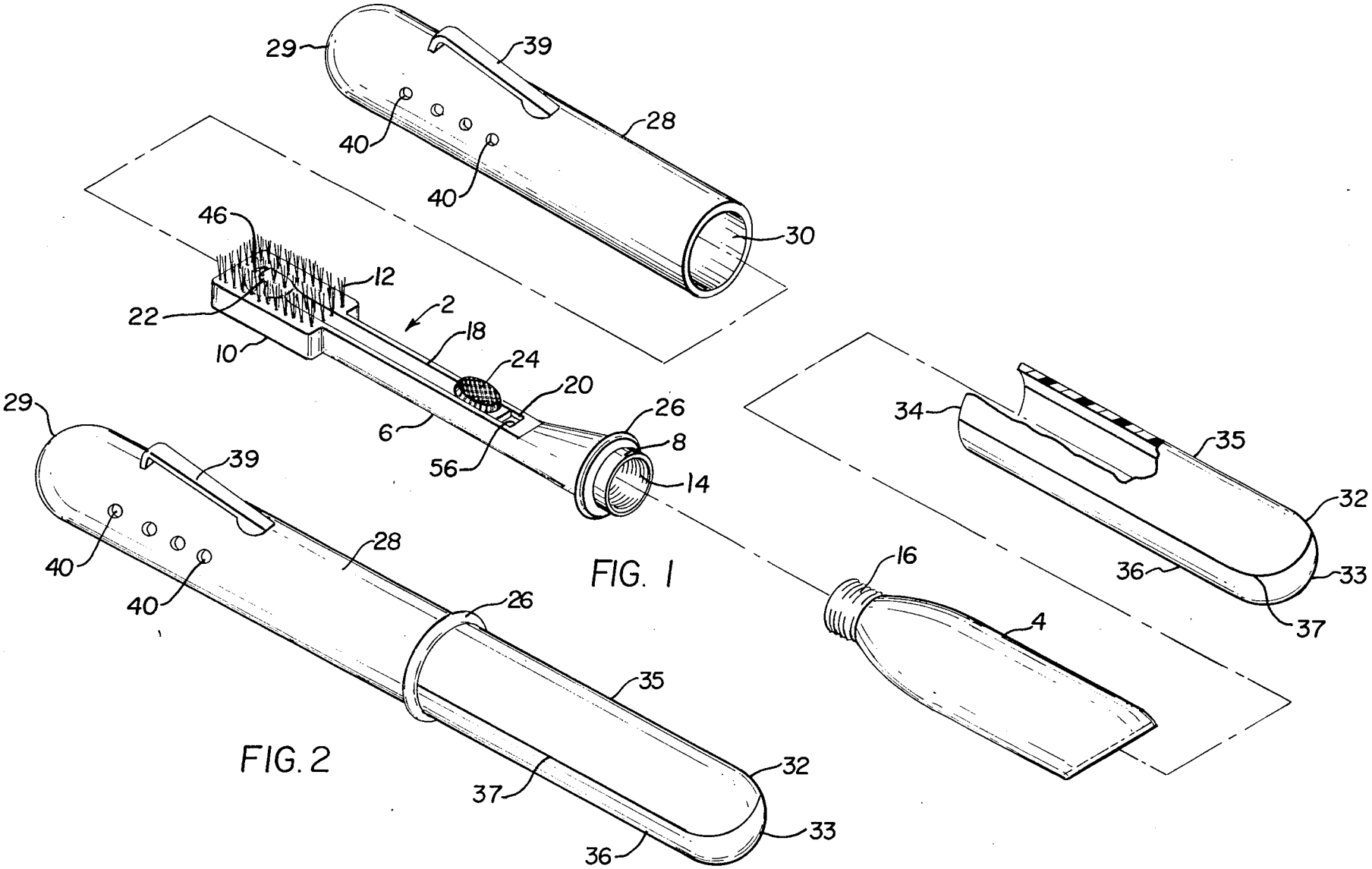
FIG. 1 is an exploded view, in perspective, of the parts of a pocket toothbrush and toothpaste container in accordance with the present invention.
FIG. 2 is a perspective view of the pocket toothbrush shown in FIG. 1 assembled together.

Referring to FIGS. 1 and 2, there is shown a pocket toothbrush in accordance with my invention. The pocket toothbrush includes a toothbrush 2 having a toothpaste container 4 mounted directly thereto. The toothbrush 2, which will be explained hereinafter in more detail, includes an elongated shank 6 which terminates in a first end formed as a wider shoulder 8 having a generally circular outer configuration. The shank 6 of toothbrush 2 has a brush head 10 at a second end thereof. A plurality of bristles 12 are carried by the brush head 10 and extend outwardly from an upper surface thereof. The shoulder 8 of the toothbrush 2 has therein an internally threaded socket 14 which is adapted to receive the externally threaded outlet nipple 16 of the toothpaste container 4 and threadedly join the toothpaste container 4 to the toothbrush 2.

An elongated slide mechanism 18 is provided in a channel 20 in the upper surface of the shank 6. The slide 18 and channel 20 extend along the shank 18 and into the brush head 10. The slide 18 has a first end formed in a plug 22 which is disposed within the bristles 12. A thumb bead 24 is provided on the slide 18 at its second end. The plug 22 is complementary with an opening (not visible in FIGS. 1 and 2) in the brush head 10 within the bristles 12 and, as will be shown hereinafter, a longitudinal passageway extends through the toothbrush 2 from the opening to the internally threaded socket 14 in the shoulder 8 of the shank 6. In this manner, toothpaste from container 4 may flow through the passageway and directly into the bristles 12 carried by the brush head 10. The slide 18 may be moved in a slidable manner back and forth within the channel 20, to open and close the opening in the brush head 10 and control the flow of toothpaste to the bristles 12.

The shoulder 8 of shank 6 may include an upraised rib 26 extending circumferentially about its outer surface. Rib 26 functions to divide the outer surface area of shoulder 8 into two separate areas. The toothbrush 2 may be protected from contamination and the like by a tubular cover 28. Cover 28 is an elongated cylindrical tube with a closed top 29 and an open bottom 30. The inner diameter of open bottom 30 is about the same as the outer diameter of shoulder 8. The cover 28 fits over the toothbrush 2 and contacts the outer surface of the shoulder 8. The rib 26 limits the movement of the cover 28 along the shoulder 8 and the cover 28 is removably engaged with the shoulder 8 by the frictional contact therebetween. The toothpaste container 4 may be covered by a tubular base 32. Base 32 is an elongated cylindrical tube with a closed bottom 33 and an open top 34. The inner diameter of open top 34 is about the same as the outer diameter of shoulder 8. The base 32 fits over container 4 and contacts the outer surface of shoulder 8. The rib 26 limits the movement of base 32 along the shoulder 8 and separates the base 32 from the cover 28. As with the cover 28, the base 32 is removably engaged with the shoulder 8 by the frictional engagement therebetween. It is also possible to mount the cover 28 and base 32 to the shoulder 8 by other means, such as by external threads on shoulder 8 and an internally threaded socket on the open bottom 30 of cover 28 and on the open top 34 of base 32. However, a simple frictional engagement is preferred.

In order to squeeze the toothpaste container 4 while it is covered by the base 32, it is desirable to have at least the upper portion of the entire length of the base 32 formed of a flexible material. As shown in FIGS. 1 and 2, upper portion 35 of base 32 is separated from lower portion 36 by a parting line 37 which extends from top 34 longitudinally along the length of base 32 to bottom 33 and extends longitudinally along base 32 back to top 34. The lower portion 36 is ideally formed of a rigid material to form a surface against which the toothbrush container 4 may be squeezed. The size of the upper, flexible portion 35 is not critical, although it is preferred to be slightly less than one-half of the total surface area of the base 32. Upper portion 35 may advantageously be formed of a clear material so that the amount and position of toothpaste remaining in container 4 can be easily observed without removing base 32 from the toothbrush 2.

When all of the parts of the device shown in FIG. 1 are assembled together, as shown in FIG. 2, they form a pocket toothbrush which may be easily carried. By providing cover 28 with a pocket clip 39, the device may be secured to a pocket. The cover 28 may also be provided with a plurality of vent holes 40 therethrough so that any moisture on the toothbrush 2 can be permitted to evaporate. The vent holes 40 should be located in the portion of cover 28 closer to top 29 so that the vent holes 40 are adjacent brush head 10 and bristles 12 when the cover is mounted on toothbrush 2. By merely removing the device from one's pocket and removing the cover 28, the toothbrush 2 is ready to be used. No separate source of toothpaste is needed since container 4 is already mounted directly thereto.

The toothbrush 2 shown in FIG. 1 is shown in more detail in FIGS. 3–8. In addition to the various elements identified above, the toothbrush 2 also includes a longitudinal passageway 42 which extends from the internally threaded socket 14 at shoulder 8, extends through the shank 6 and into the brush head 10, and exits in an opening 44 within the bristles 12 in the brush head 10. It is preferred that the upper surface of the brush head 10 be formed with a raised portion 46 and the passageway 42 extend through the raised portion 46 and exit in said opening 44 at the top of the raised portion 46. The raised portion 46 extends upwardly to a distance of, preferably, about one-half the height of the bristles 12. By the use of raised portion 46, toothpaste exiting from passageway 42 through opening 44 will be deposited near the upper area of the bristles 12 rather than at the bottom of the bristles 12 near the upper surface of the brush head 10. In this manner, the toothpaste will be distributed more evenly and in a more usable location.

It is preferred that the raised portion 46 be formed with a smooth, arcuate shaped outer surface as shown so that a user's gums are not scratched or otherwise harmed by the raised portion 46 during use of the toothbrush 2. In the embodiment shown in FIGS. 3–8, the plug 22 on the slide 18 has an arcuate outer surface and is complementary with the raised portion 46 such that an unbroken arcuate surface is formed when the slide 18 is moved with the plug 22 covering the opening 44. To this effect, raised portion 46 has a relatively thin, flat wall 48 which extends downwardly toward the brush head 10 and the channel 20 and is disposed toward the slide 18. The plug 22 is formed of a neck portion 50 at the first end of the slide 18 and a closure portion 52 connected at an upper end of the neck portion 50 and extending outwardly therefrom and substantially parallel with the brush head 10. The closure portion 52 has a downwardly extending projection 54 which is adapted to extend into and seal off opening 44. The neck 50 of the plug 22 has a flat front face 55 which abuts against wall 48 when the plug 22 is moved into a position covering opening 44. The neck portion 50 and closure portion 52 have a continuous and unbroken arcuate outer surface which, when the plug 22 is positioned to close off opening 44, is complementary with and completes the arcuate outer surface of the raised portion 46.

It is preferable that the surface area covered by the raised portion 46, including the area covered by the raised plug 22, be on the order of about one-third of the upper surface area of the brush head 10. It is also advantageous to locate the raised portion 46 more toward the distal end 60 of the brush head 10 for more effective distribution of the toothpaste. The precise number and arrangement of the bristles is more a matter of preference. In the arrangement shown in the Figures, particularly in FIGS. 7 and 8, the brush head 10 includes forty-eight groupings of bristles 12 arranged in a four by twelve rectangular pattern. Moving from the distal end 60, the brush head 10 has two rows of four bristles 12 each before the raised portion 46 begins. Then the brush head 10 has four rows of bristles 12 which extend across the raised portion 46 and plug 22. The remaining six rows of bristles 12 extend across the balance of the brush head 10. In order to provide an unbroken upper surface of the bristles, it is desirable that the bristles be mounted directly to the raised portion 46, plug 22 and slide 18 as shown in the Figures.

Figure 6:
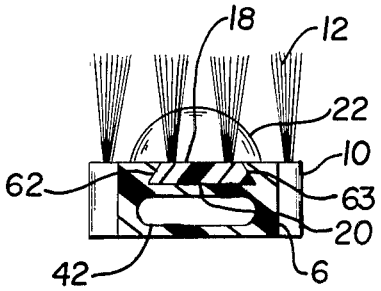
FIG. 6 is a section taken along lines VI—VI in FIG. 3.
Figure 9:
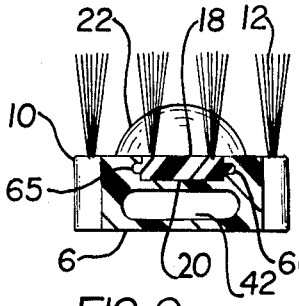
FIG. 9 is a cross section similar to FIG. 6 and showing a second configuration for the channel.
Figure 10:
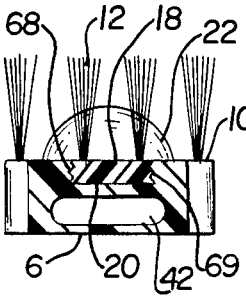
FIG. 10 is a cross section similar to FIG. 6 and showing a third configuration for the channel.
Figure 11:
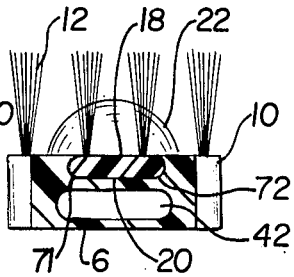
FIG. 11 is a cross section similar to FIG. 6 and showing a fourth configuration for the channel.

The channel 20 must have a configuration which will hold the complementary shaped slide 18 securely within the shank 6 of the toothbrush 2. The preferred configuration is shown in FIG. 6 in which the channel 20 has opposed and spaced sidewalls 62, 63 which angle downwardly away from one another to form a trapezoid-shaped channel. Other arrangements are possible and several are shown in FIGS. 9–11. As shown in FIG. 9, sidewalls 65 and 66 each have an elongated notch therein and slide 18 is held therein by a corresponding elongated rib on the slide 18. As shown in FIG. 10, sidewalls 68 and 69 have a zig-zag configuration which, in actuality, constitutes a plurality of elongated notches. As shown in FIG. 11, sidewalls 71 and 72 are arcuate in configuration. While the arrangement in FIG. 11 shows the sidewalls 71, 72 both curving outward, the sidewalls could also both curve inward, or one could curve inward with the other curving outward. In order to facilitate removal and insertion of the slide 18 within the channel 20, it is desirable to provide a straight wall section adjacent the rear wall 56 of the channel with the straight wall section having a width slightly wider than the maximum width of the slide 18.

Figure 3:
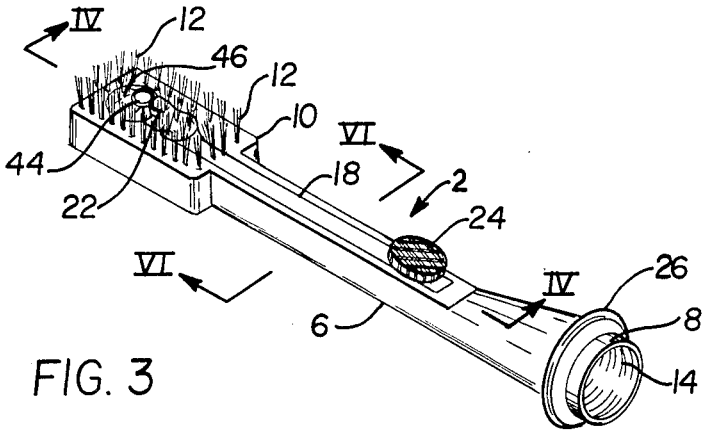
FIG. 3 is a perspective view of a toothbrush adapted to be mounted onto a toothpaste container and with the slide in the open position.
Figure 4:
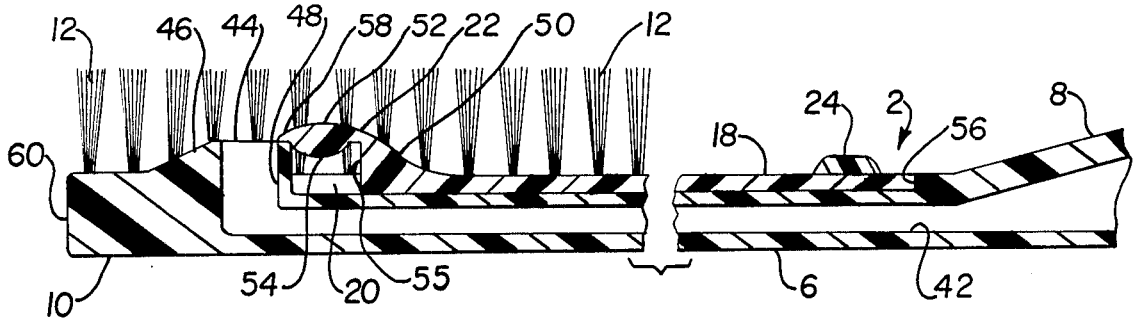
FIG. 4 is a section taken along lines IV—IV in FIG. 3.
Figure 5:
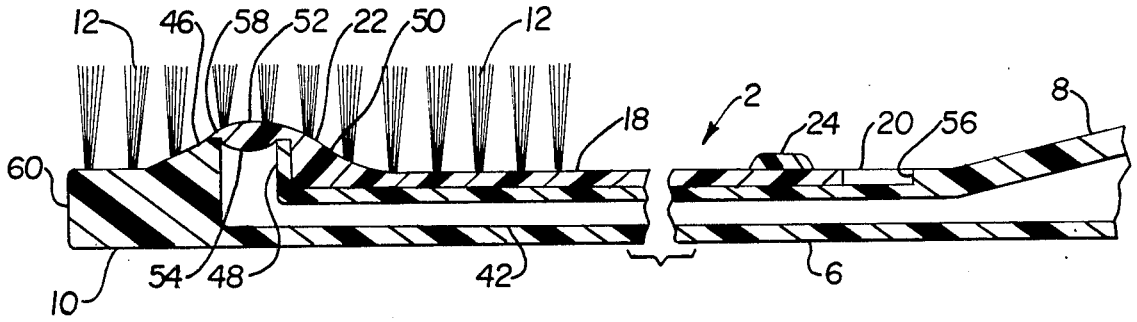
FIG. 5 is the section shown in FIG. 4 with the slide in the closed position.
Figure 7:
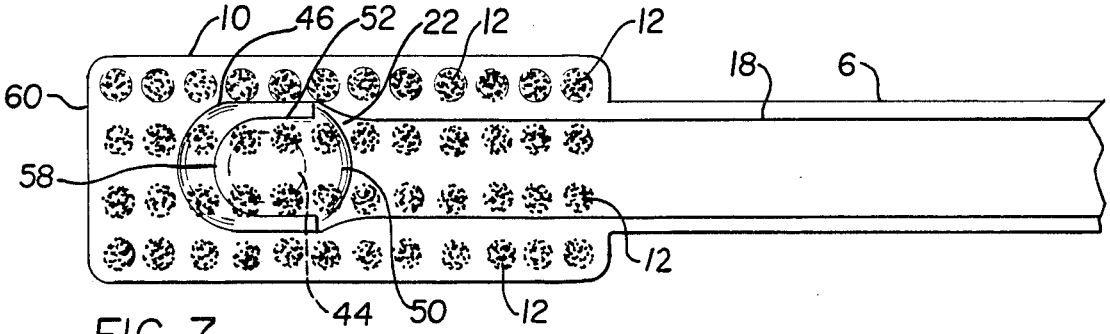
FIG. 7 is a top plan view of the brush head of the toothbrush shown in FIG. 3 with the slide in the closed position.
Figure 8:
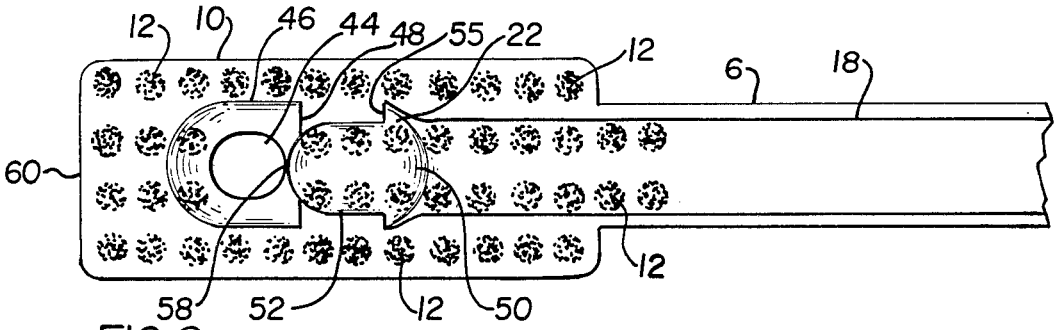
FIG. 8 is the top plan view shown in FIG. 7 with the slide in the open position.

The operation of the toothbrush 2 may be explained by reference to FIGS. 1 and 2–8. The slide 18 may be moved in a slidable manner back and forth within channel 20 by exerting appropriate force on the thumb bead 24. In a first position, as shown in FIGS. 1, 5, and 7, the slide 18 is moved with the front face 55 of neck portion 50 adjacent wall 48 and the plug 22 completely covering opening 44. The projection 54 on closure portion 52 extends into opening 44 and prevents any toothpaste from flowing through the passageway 42 or from becoming contaminated or solidified therein. When it is desired to deposit toothpaste on the bristles 12, the slide 18 is moved back away from the raised portion 46 until the opening 44 is completely uncovered as shown in FIGS. 3, 4, and 8. It is desirable that the channel 20 be provided of a specific length such that when the end of the slide 18 adjacent thumb bead 24 abuts against a rear wall 56 of the channel 20, the projection 54 lies beyond wall 48 and the tip 58 of closure portion 52 lies on the top of wall 48 as shown in FIGS. 4 and 8. It is also desirable that the plug 22 be formed such that closure portion 52 is biased downward slightly, with a so-called spring effect, and always remains tightly in contact with the raised portion 46. After a desired quantity of toothpaste is deposited on the bristles 12, the slide 18 is moved back to the first position with the plug 22 covering the opening 44 and the toothbrush 2 is ready to be used.

Figure 12:
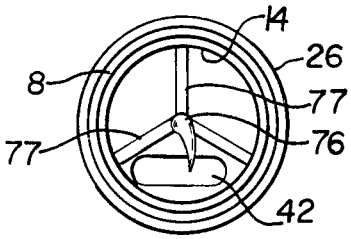
FIG. 12 is an end view of a second embodiment of the toothbrush shown in FIG. 3.
Figure 13:
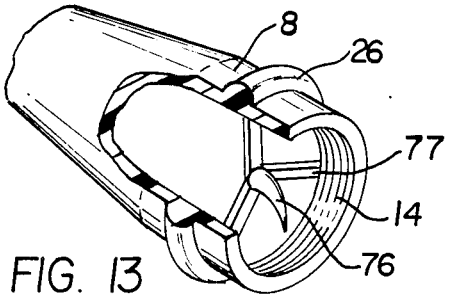
FIG. 13 is a perspective view, partially broken away, of the toothbrush shown in FIG. 12.
Figure 14:
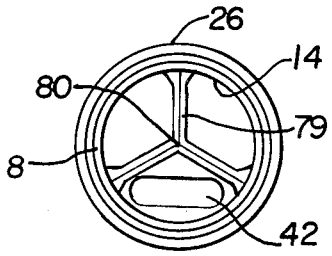
FIG. 14 is an end view of a third embodiment of the toothbrush shown in FIG. 3.
Figure 15:
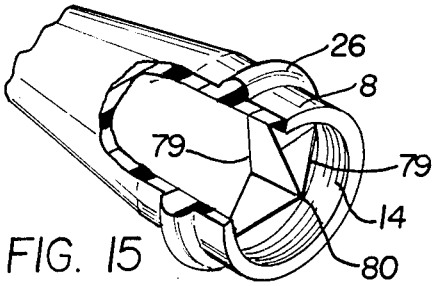
FIG. 15 is a perspective view, partially broken away, of the toothbrush shown in FIG. 14.

The arrangement of the toothbrush 2 shown in FIGS. 1–11 can be easily mounted onto a standard toothpaste tube. It is also desirable that the toothbrush 2 be capable of use in connection with the aerosol type of toothpaste container. Such containers include a supply of toothpaste under pressure and the outlet nipple of the container is covered with a thin plastic or thin foil covering or the like. In order to use an aerosol toothpaste container, it is necessary to include a means within the internally threaded socket 14 for rupturing this plastic or foil covering when the container is mounted to the toothbrush 2. Moreover, it is necessary that the toothpaste be able to flow around the rupture means and into the longitudinal passageway 42. One such rupture means is shown in FIGS. 12 and 13. An elongated pointed member 76 is mounted within and to the internally threaded socket 14 on a plurality of thin support arms 77. Pointed member 76 is centrally mounted and is curved off to one side in a slight hook. The tip of member 76 will pierce the covering of the aerosol toothpaste container as it is being threaded thereon and member 76 will carve out an opening through the container covering. The opening will be larger than member 76 and toothpaste can freely flow around member 76 and into passageway 42. Another rupture means is shown in FIGS. 14 and 15. A plurality of spaced and substantially flat blades 79 are mounted within and to socket 14. Three blades 79 are shown and are arranged in a star pattern with their interior edges joined together in about the center of socket 14 and forming a downstream point 80. Blades 79 function to open the covering to an aerosol toothpaste container in the same manner as member 76 shown in FIGS. 12 and 13. Blades 79, hook member 76 and support arms 77 are preferably made of a plastic material. When using the toothbrush 2 with an aerosol toothpaste container mounted thereto, it is preferred that the toothbrush 2 be held upward at about a 45° angle so that the toothpaste will move down over the bristles 12.

The toothbrush 2 will be advantageously molded from a plastic material. The shank 6, brush head 10, and shoulder 8 will be molded as a single unit with channel 20 formed therein and with appropriate bristles 12 molded thereto. The slide 18, including plug 22 and thumb bead 24, will be molded as a separate unit with appropriate bristles 12 molded thereto. The slide 18 can then be placed directly into the channel 20 and the toothbrush 2 is ready to be used. By the use of a plastic material, the toothbrush 2 is inexpensive and easy to manufacture, requiring two parts. There are no metal parts to become corroded and the toothbrush 2 can be easily taken apart for cleaning. In addition, the toothbrush 2 can be easily held and operated with only one hand by using the thumb bead 24 to operate the slide 18.

Having described hereinabove the presently preferred embodiments of the invention, it is to be understood that it may be otherwise embodied within the scope of the appended claims.

I claim:

1. A toothbrush adapted to be mounted onto a toothpaste container comprising:

an elongated shank having means for mounting a toothpaste container to a first end thereof and having a brush head at a second end;

a plurality of bristles carried by said brush head and extending outwardly from an upper surface thereof;

a raised portion in the upper surface of said brush head, said raised portion having an arcuate outer surface;

a longitudinal passageway extending from said first end of said shank, through said shank, through said raised portion and exiting in an opening in the top of said raised portion within said bristles in said brush head; and a slide mechanism at an upper surface of said shank which extends along said shank and into said brush head and means mounting said slide mechanism to said shank for slidable movement therewith, said slide mechanism having a first end disposed within said bristles and formed in a plug complementary with said opening, with said slide mechanism movable from a first position in which said plug completely covers said opening to a second position in which said opening is uncovered, with said plug having an arcuate outer surface which is complementary with said raised portion, whereby an unbroken arcuate outer surface is formed when the slide mechanism is moved to said first position with said plug covering said opening.

2. The toothbrush of claim 1 wherein said means mounting said slide mechanism to said shank is an elongated channel in the upper surface of said shank, with said slide mechanism in slidable engagement with said channel.

3. The toothbrush of claim 2 wherein said channel includes a pair of opposed and spaced sidewalls which angle downwardly away from each other.

4. The toothbrush of claim 2 wherein said channel includes a pair of opposed and spaced sidewalls having an arcuate configuration.

5. The toothbrush of claim 2 wherein said channel includes a pair of opposed and spaced sidewalls, each of said sidewalls having at least one elongated notch therein, with said slide mechanism having an elongated rib complementary with and engaging each of said notches in said sidewalls.

6. The toothbrush of claim 1 wherein the surface area defined by said raised portion is about one-third the area of the upper surface of said brush head.

7. The toothbrush of claim 1 wherein the height of said raised portion is about one-half the height of said bristles.

8. The toothbrush of claim 1 further including a plurality of bristles on said first end of said slide mechanism.

9. The toothbrush of claim 1 further including a thumb bead on a second end of said slide mechanism.

10. The toothbrush of claim 1 wherein said means for mounting a toothbrush container thereto is an internally threaded socket in said first end with said socket in fluid communication with said longitudinal passageway.

11. The toothbrush of claim 10 further including means within said socket for rupturing the top of an aerosol toothpaste container when mounted thereto.

12. The toothbrush of claim 11 wherein said rupturing means is a hook-shaped member pointed at one end and axially mounted to said socket.

13. The toothbrush of claim 11 wherein said rupturing means is a plurality of spaced blades mounted to said socket.

14. The toothbrush of claim 1 further including a tubular cover which fits over said brush head and shank and is removably engaged with said first end of said shank.

15. The toothbrush of claim 14 further including a tubular base which fits over a toothpaste container mounted to said shank and is removably engaged with said first end of said shank.

16. The toothbrush of claim 15 wherein said tubular base has at least an upper portion along its length thereof which is formed of a flexible material.

* * * * *